US009101815B2

(12) United States Patent
Conolly et al.

(10) Patent No.: US 9,101,815 B2
(45) Date of Patent: Aug. 11, 2015

(54) WATERSPORT HIKING SUPPORT SYSTEM

(75) Inventors: Brian Conolly, Linley Point (AU); Bartoz Milczarczyk, Glebe (AU)

(73) Assignee: ZHIK PTY LTD (AU)

( * ) Notice: Subject to any disclaimer, the term of this patent is extended or adjusted under 35 U.S.C. 154(b) by 924 days.

(21) Appl. No.: 12/180,069

(22) Filed: Jul. 25, 2008

(65) Prior Publication Data

US 2009/0031478 A1 Feb. 5, 2009

(30) Foreign Application Priority Data

Jul. 27, 2007 (AU) ..... 2007904069

(51) Int. Cl.
*A41D 13/015* (2006.01)
*A63B 71/12* (2006.01)
*A41D 13/00* (2006.01)

(52) U.S. Cl.
CPC ..... *A63B 71/12* (2013.01); *A41D 13/0015* (2013.01); *A41D 13/015* (2013.01); *A63B 71/1225* (2013.01); *A63B 2071/125* (2013.01); *A63B 2071/1233* (2013.01); *A63B 2071/1241* (2013.01)

(58) Field of Classification Search
USPC ..... 2/455, 456, 22, 23, 24, 61, 62, 79, 214, 2/215, 227, 231, 233, 239, 240, 241, 309, 2/311–322, 248, 249, 250, 251, 252, 267, 2/268, 270, 911, 919, 920
See application file for complete search history.

(56) References Cited

U.S. PATENT DOCUMENTS

| | | | | |
|---|---|---|---|---|
| 4,325,148 | A * | 4/1982 | Livernois | 2/465 |
| 4,450,832 | A * | 5/1984 | Waddell | 602/16 |
| 4,733,656 | A * | 3/1988 | Marquette | 602/26 |
| 4,793,333 | A * | 12/1988 | Marquette | 602/26 |
| 5,161,257 | A * | 11/1992 | Arensdorf et al. | 2/465 |
| 6,186,970 | B1 * | 2/2001 | Fujii et al. | 602/75 |
| 6,243,879 | B1 * | 6/2001 | Lyden | 2/227 |
| 6,745,406 | B2 * | 6/2004 | Ruane | 2/465 |
| 7,516,498 | B2 * | 4/2009 | Torry | 2/69 |
| 2001/0014981 | A1 * | 8/2001 | Fairhurst et al. | 2/69 |
| 2002/0178483 | A1 * | 12/2002 | Beland | 2/22 |
| 2003/0092544 | A1 * | 5/2003 | Reed | 482/105 |
| 2004/0107479 | A1 * | 6/2004 | Dicker et al. | 2/227 |
| 2005/0054759 | A1 * | 3/2005 | Smith et al. | 524/284 |
| 2006/0026732 | A1 * | 2/2006 | Nordt et al. | 2/69 |
| 2006/0130215 | A1 * | 6/2006 | Torry | 2/227 |
| 2007/0074430 | A1 * | 4/2007 | Coomer | 36/145 |
| 2007/0204481 | A1 * | 9/2007 | Conolly | 36/8.1 |
| 2008/0022431 | A1 * | 1/2008 | Gallo et al. | 2/69 |
| 2008/0120757 | A1 * | 5/2008 | Nakazawa | 2/22 |
| 2008/0125842 | A1 * | 5/2008 | Petitt | 607/108 |

FOREIGN PATENT DOCUMENTS

GB 2431563 A * 5/2007

* cited by examiner

*Primary Examiner* — Bobby Muromoto, Jr.
(74) *Attorney, Agent, or Firm* — Whitmyer IP Group LLC

(57) ABSTRACT

A device that provides support for sailors while hiking from a sailing vessel is disclosed. The device is a pair of sleeves tailored with pockets under each thigh that allow for supporting pads to be inserted in various combinations. The pads are ergonomically designed and can be designed with internal fibreglass battens, or moulded plastic, and optionally in shapes that help apply torque to the boat dynamics. The sleeves are designed with one way stretch to optimise grip to the leg, and constructed in a choice of composite materials to aid durability and comfort.

20 Claims, 8 Drawing Sheets

WATERSPORT HIKING SUPPORT SYSTEM

CROSS-REFERENCE TO RELATED APPLICATIONS

The present application claims priority of Australian patent application No. 2007904069 filed on Jul. 27, 2007, the content of which is incorpo-rated herein by reference.

FIELD OF THE INVENTION

The invention generally relates to the field of sportswear products. More specifically, the invention relates to combining a novel hiking support system with sports clothing, such as a wetsuit, to help reduce muscle fatigue in situations such as hiking from the gunnels of a sailing vessel.

BACKGROUND OF THE INVENTION

Any discussion of the prior art throughout the specification should in no way be considered as an admission that such prior art is widely known or forms part of common general knowledge in the field.

Hiking support systems have been applied to wetsuits for dinghy sailing for some time, typically for hiking from a sailing dinghy like that shown in FIG. 1. These systems typically comprise a set of fibreglass battens that are sewn directly into the wetsuit behind the thigh portion, or alternatively pads that are inserted into pockets or otherwise directly connected to the thigh portions of the wetsuit.

Such systems have a variety of functional problems because the hiking support pads or battens are connected directly to a wetsuit. Also, in such systems, the wetsuit is commonly constructed of a material that will stretch when wet or with repetitive use, which in turn causes the hiking support to fail to hold the battens or pads firmly in place around the leg. To compensate for these structural problems, these wetsuits are commonly designed to be very tight fitting on initial purchase. As durability is also a problem when the hiking support system is connected directly with the wetsuit, the wetsuit is commonly made with thick abrasive resistant material, which in turn makes them heavier and less comfortable to wear.

SUMMARY OF THE INVENTION

It is an object of the present invention to provide an improved hiking support system.

In accordance with a first aspect of the present invention there is provided a hiking support systems comprising:

- a first sleeve portion having a pocket for receiving at least one resilient pad of predetermined stiffness;
- wherein the sleeve portion, having the pad inserted, is adapted to be worn by a user for providing support to the user while hiking.

Preferably, the sleeve portion comprises a substantially planar panel, wherein opposite ends of the panel are releasably fastenable together to define the sleeve. The sleeve, having the pad inserted, is preferably adapted to be worn by a user beneath a wetsuit. More preferably, the system is manufactured with the pad fixedly inserted in the pocket of the sleeve portion.

The sleeve portion is preferably adapted to include a stretch gradient for restricting movement of the sleeve portion during use. Preferably, the stretch gradient is included by a printed pattern on a surface of the sleeve portion. Alternatively, the sleeve portion includes a nylon layer, wherein the nylon layer can be manufactured to incorporate the stretch gradient in its weave. More preferably, the sleeve portion is further adapted to substantially only stretch in one-direction.

Preferably, the top and/or the bottom of the sleeve portion further includes an internal band of gripping material for griping the leg of the user and reducing the possibility of the system moving down the leg during use.

In accordance with a second aspect of the present invention there is provided a method of providing improved hiking capabilities, the method including the step of:

- providing a hiking system as previously described and
- providing pads of various stiffness which can be inserted into the pockets in different combinations depending on sailing conditions.

In accordance with a third aspect of the present invention there is provided a hiking support systems comprising:

- a first substantially planar panel adapted to releasably fasten opposite ends of the panel together to define a first sleeve portion; the panel including a pocket for receiving at least one resilient pad of predetermined stiffness;
- wherein the sleeve portion, having the pad inserted, is adapted to be worn by a user for providing support to the user while hiking.

Preferably, the panel is adapted for wrapping around the thigh of the user and fastening in a fitted operative sleeved configuration. More preferably, the panel is adapted to include a stretch gradient for restricting movement of the sleeve portion during use. Most preferably, the system is manufactured with the pad fixedly inserted in the pocket. The fastening is preferably achieved using a Velcro closure.

In accordance with a further aspect of the present invention there is provided a method of providing improved hiking capabilities, the method including the step of: providing a hiking system with pads of various stiffness which can be inserted in different combinations depending on sailing conditions into a pair of durable pockets sewn into thigh sleeves.

In accordance with a further aspect of the present invention, in preferred embodiments, there is provided an interchangeable pairs of pads, made of composite material, housed in a pocket behind each thigh in a separate thigh sleeve worn under, and separate to, an outer suit. There is one thigh sleeve for each leg to house the hiking support. The sailor then wears a more conventional wetsuit over the top of these thigh sleeves. The removable pad is designed to produce a seamless surface that will be both stiff in the vertical direction and yet flexible in the horizontal direction. The pads can be varied in all dimensions, including flexibility and in depth depending on the users requirements and weather conditions. Pads of different types can also be joined together (for example using Velcro) and used in various combinations together in the same pocket, for different conditions or user requirements. As shown in the accompanying drawings, the application of Velcro is preferably the centre of the pad such that they can combine and maintain flexibility around the leg. The pads can be easily removed entirely, for example if a sailor sails in light winds where the extra weight of the pads is unnecessary and extra flexibility for the sailor is an advantage. The pads can also be shaped to help optimise the ability of the sailor to torque the boat, with wider regions and increased surface area towards deck side of the boat.

In preferred embodiments, the thigh sleeve and pad pocket design is made of a combination of soft, hard wearing, and gripping materials. Optionally the thigh sleeve and pad pocket design can include a specific horizontal or vertical one way stretch direction, in order to optimise fitting and to restrict the thigh sleeves from falling or moving down the leg during use.

In one embodiment the thigh sleeve and pad pocket material is made of nylon laminated neoprene. The nylon laminated on the side of the neoprene that touches the skin can be made soft and comfortable, and optionally chosen to be 'grippy' when wet. The material laminated to the outer panel lining, and optionally to the internal lining to the pocket, can be made of a more abrasive resistant nylon. The laminates are optionally chosen to stretch in a one-way vertical direction, so as to help reduce the possibility that the sleeve will fall down the leg during use. The user can place the thigh sleeves with pads inserted onto their leg at their own personal custom position. They then wear an outer wetsuit, which is preferably designed to have good abrasive resistance around the areas of the thigh sleeve. This outer wetsuit is not connected to the thigh sleeves, and just wraps over the top and is not critical to the function of the hiking suit. This outer wetsuit can then be made of lighter and stretchier materials than other hiking support systems, which can increase the comfort for a user.

BRIEF DESCRIPTION OF THE DRAWINGS

Notwithstanding any other forms which may fall within the scope of the present invention, preferred forms of the invention will now be described, by way of example only, with reference to the accompanying drawings in which.

DETAILED DESCRIPTION OF THE INVENTION

Figure 1:
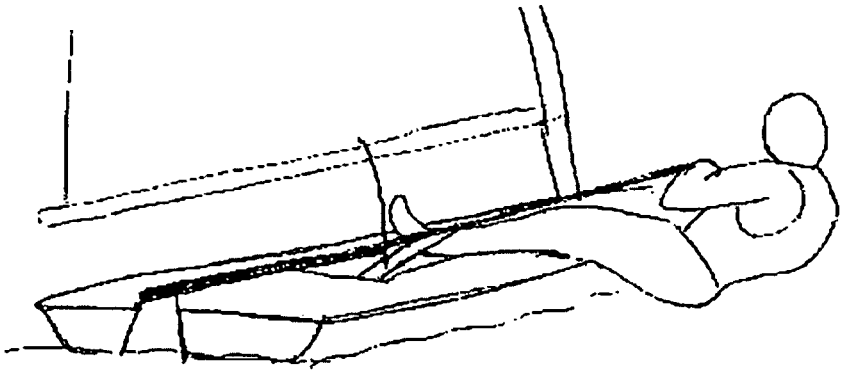
FIG. 1 illustrates an example of hiking from a sailing dinghy.
Figure 2:
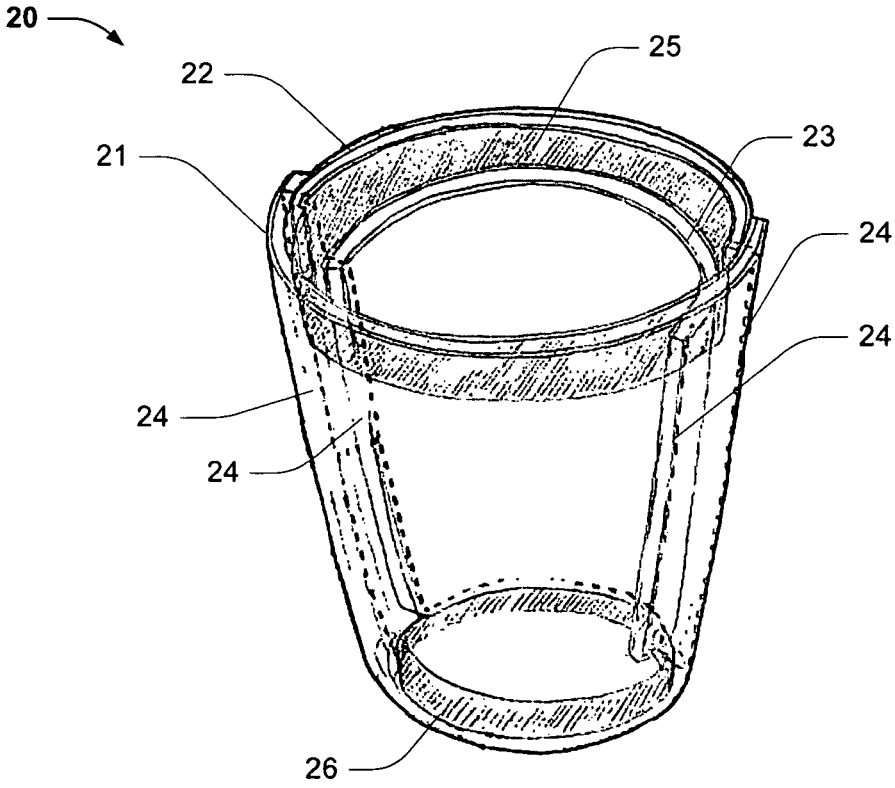
FIG. 2 illustrates an example thigh sleeve and pad pocket construction.

Referring to FIG. 2, an example thigh sleeve 20 with pad pocket is shown. The thigh sleeve is constructed of a composite of various nylons laminated to neoprene. A top panel 21 is sewn to a back panel 22 having a pocket panel 23. A simple line of stitching 24 can be used, preferably a flat lock stitch.

Optionally a gripping material 25 and 26 can be included at the top of the sleeve and/or bottom of the sleeve. The top panel 21 and/or back panel 22 are optionally designed to have one way stretch in the vertical direction to help stop the thigh sleeve from falling down the leg.

The nylon laminated to the back panel 22 is preferably made to a high abrasive resistant grade. The nylon laminated to the inside of the pocket panel 23 is also preferably a high abrasive resistant grade. The nylons laminated to the top panel 21 are preferably softer grades for comfort. All panels 21, 22 and 23 are preferably 1 mm thick neoprene.

Figure 3:
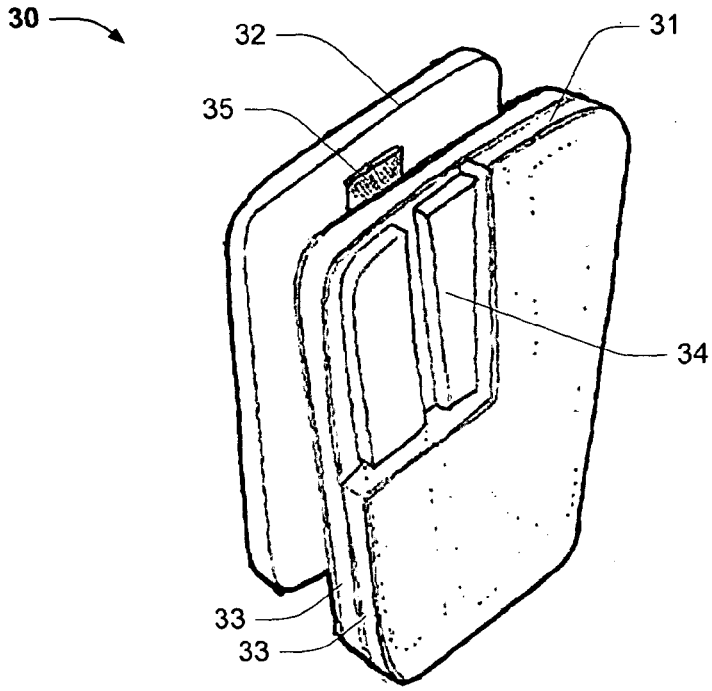
FIG. 3 illustrates an example pad combination with batten inserts.

FIG. 3 shows an example pad combination 30. A battened pad 31 is made with three 45mm wide fibreglass battens 34. These battens are cut, and sharp edges ground, to fit within two nylon laminated 5 mm neoprene sheets 33. The battened pad 31 is glued together and designed to taper from top to bottom, having curved edges, and taper at the top to match ergonomics of hiking. Soft nylon laminated neoprene sheeting material, with sufficient flexibility and durability, is required so that the whole pad will mould around a users leg comfortably.

A second pad insert 32 having no internal battens is shown. This pad is designed to simply add extra height and padding. This "extension pad" is designed to connect to the main batten pad with Velcro 35. The Velcro 35 is at the centre of the pad so the two pads can still flex around the leg without increased stiffness. In one preferred embodiment, this extension pad can be made out of EVA and is 5 mm thick.

Figure 4:
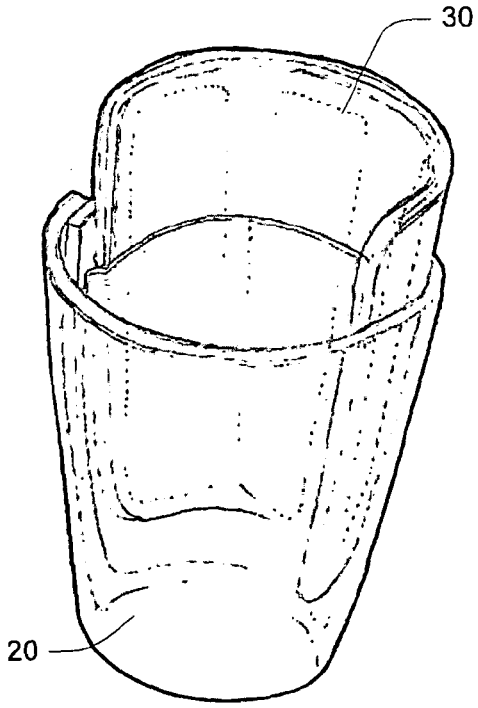
FIG. 4 illustrates the insertion of a pad combination into a thigh sleeve with pocket.

Referring to FIG. 4, the combined pads 30 are shown being inserted into the thigh sleeve 20. It will be appreciated that FIG. 4 does not show the pad fully inserted within a respective pocket. Preferably, the pads 30 (in this example comprising pad 31 and/or pad 32 as best shown in FIG. 3) when fully inserted, are shorter in the vertical direction to the thigh sleeve pocket. Preferably extra material at the top and the bottom of the thigh sleeve and pad pocket helps to keep this hiking support system grip to the leg. Optionally just the single battened pad 31 or the single extension pad 32 is inserted into the thigh sleeve, depending on the hiking support required.

Figure 5:
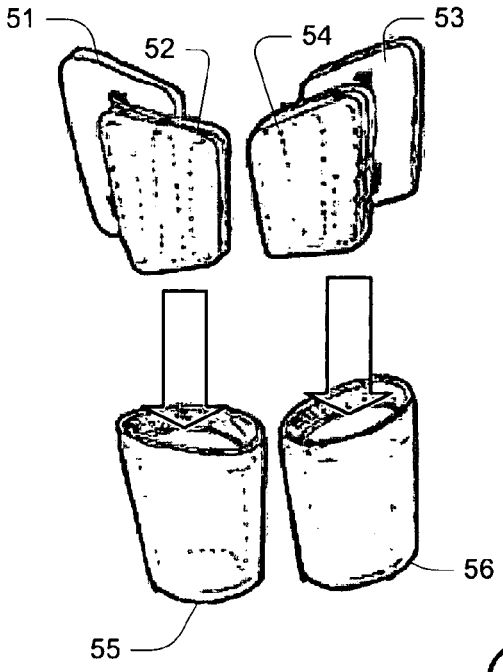
FIG. 5 Illustrates a pair of pad combinations going into left and right thigh sleeves.
Figure 6:
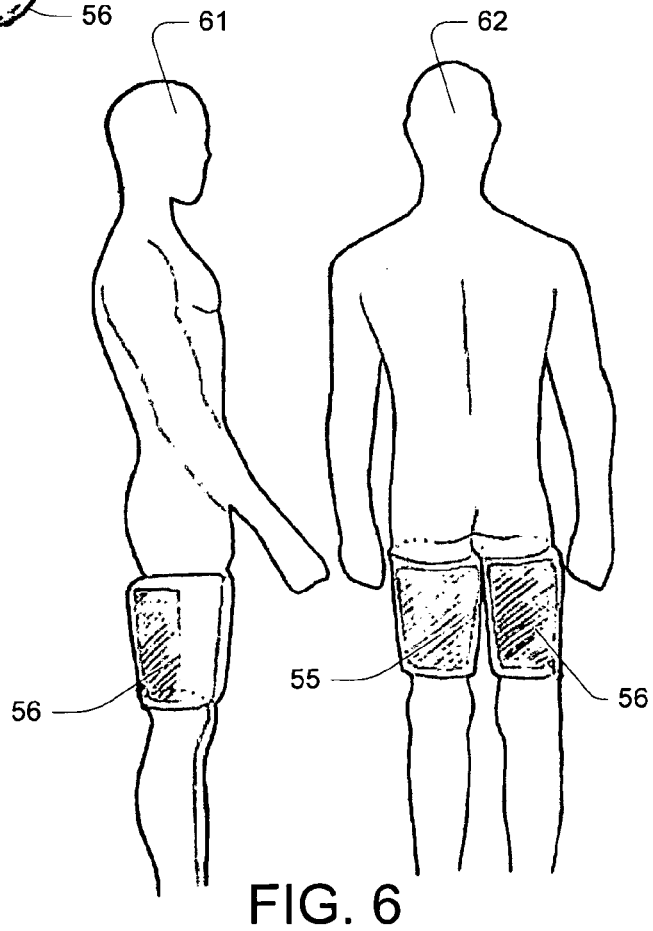
FIG. 6 Illustrates side and rear view of thigh sleeve and pad pocket placed on body.

FIG. 5 shown an example complete hiking support system comprising pads 51, 52, 53 and 54 and sleeves 55 and 56. The right thigh sleeve 56 and left thigh sleeve 55 with respective extension pads 51 and 53 and battened pads 52 and 54. These are placed on the thighs of a user as shown in FIG. 6, with side view and rear view.

Figure 7:
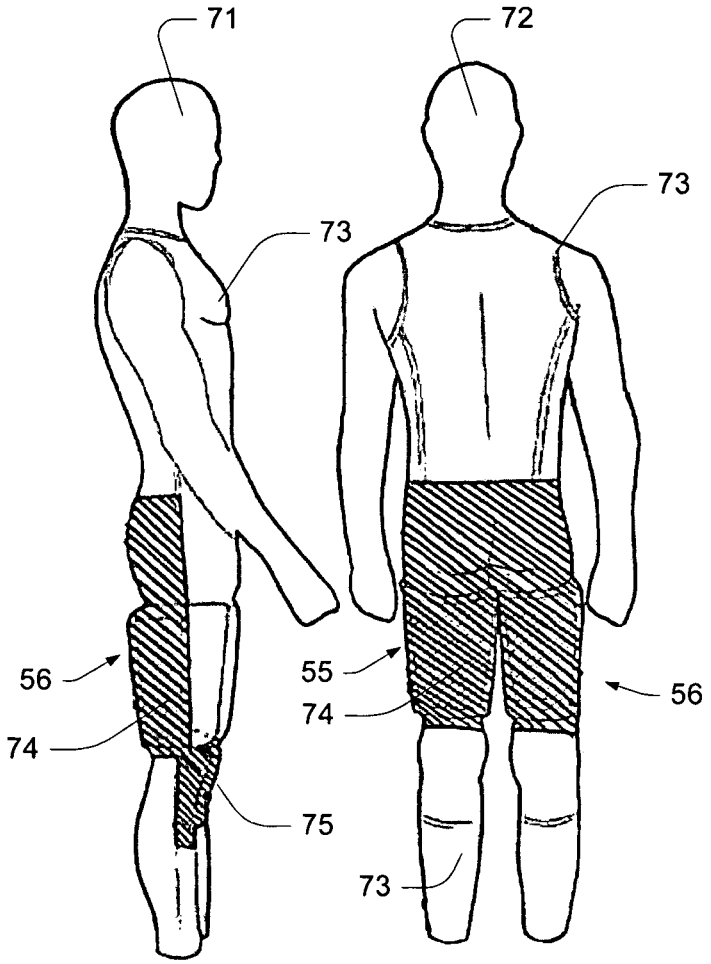
FIG. 7 Illustrates side and rear view of outer suit over thigh sleeve and pad pockets on body.

FIG. 7 shows an example wetsuit 73 can be worn over the top of the thigh sleeves. Abrasive resistant material is preferably applied in area 74. Knee pads 75 are also preferably made of an abrasive resistant material.

Figure 8:
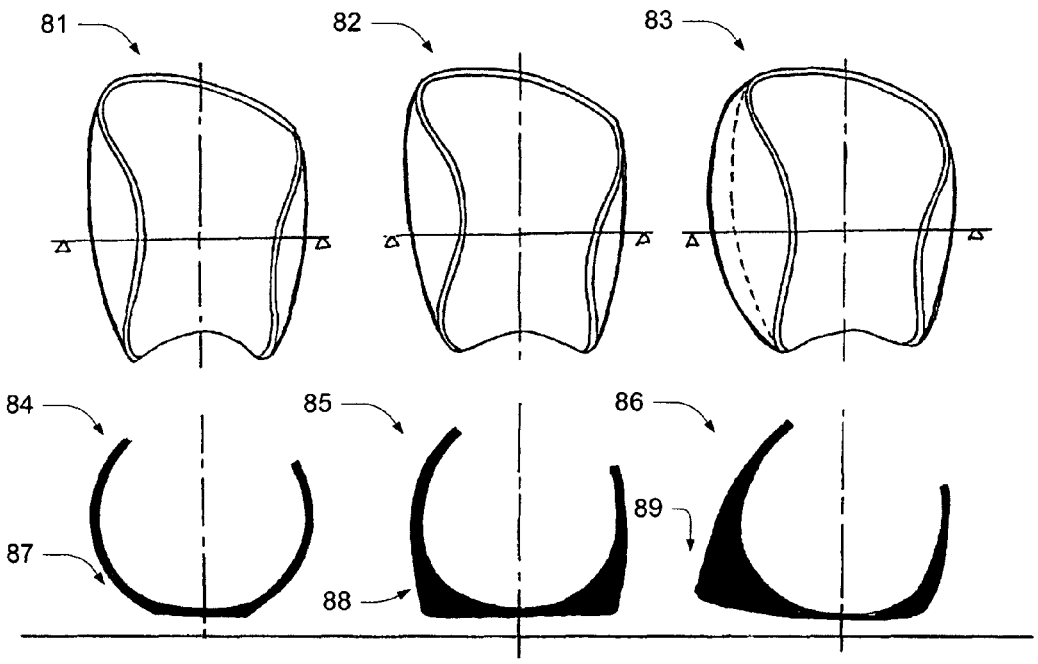
FIG. 8 Illustrates three variations of alternative pad designs for optimising torque.

Referring to FIG. 8, torque applied be to the boat can be improved with a variation of the pads. This figure shows a plan view and cross section of three example pad variations. Plan views 81, 82 and 83 are shown with their respective cross sections 84, 85 and 86.

For example, pads having cross section 85, which are moulded into a shape that has a larger surface area on the sides 88, the rocking movement of the body will have higher impact to the dynamics of the boat.

A further example pad having cross section 86, which is moulded with a shape 89, can also be of benefit.

It will be appreciated that the choice of variations in pad design will be particular to the sailor, the weather conditions, and the boat design.

Figure 9:
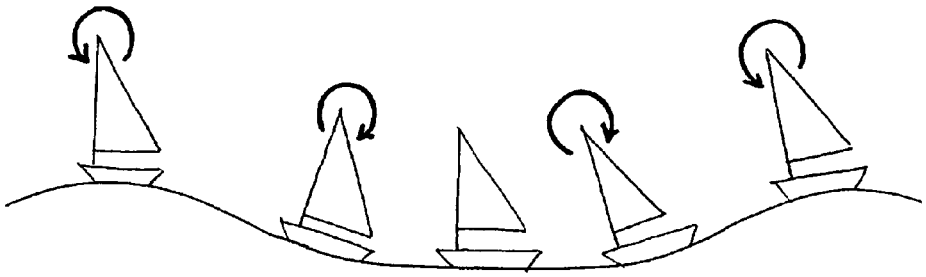
FIG. 9 Illustrates torque conditions at various points on sea state.
Figure 10:
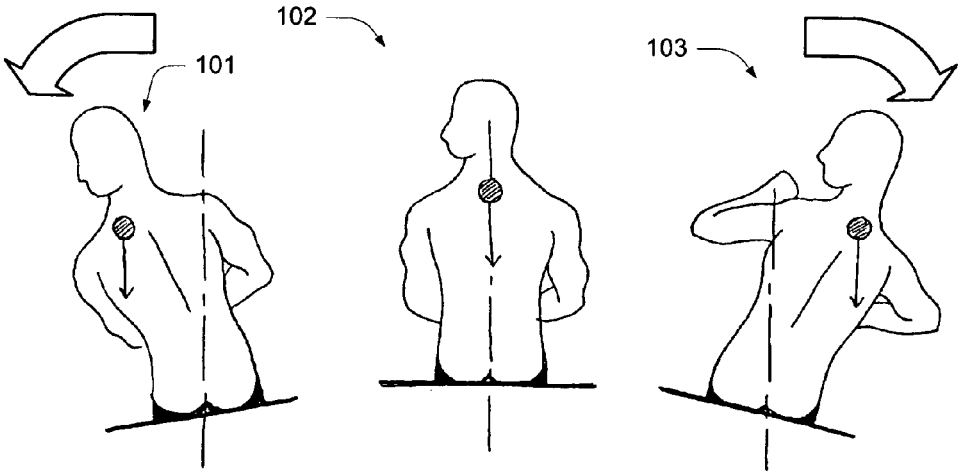
FIG. 10 Illustrates three states of hiking position that apply different torque to boat.

Referring to FIG. 9, it will be appreciated that as the sea state varies with waves in the water, the hiking sailor will apply torque to the boat, as best shown in FIG. 10. This is to assist in keeping the boats displacement in the water uniform and to optimise speed.

The pads can be optionally pre-curved in shape and constructed of moulded plastic or other synthetic material. Due to the curved shape of the pad it will be naturally stiff in the direction up and down the thigh as required for hiking support, yet flexible around the leg for comfort.

Figure 11:
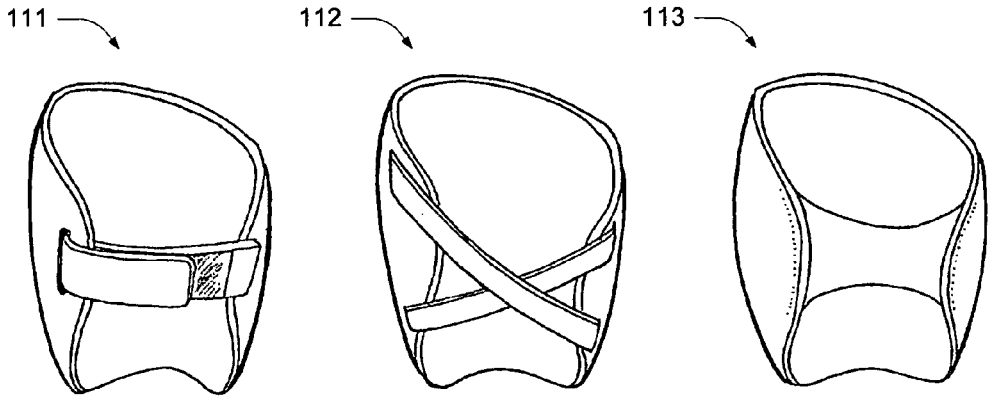
FIG. 11 Illustrates variations of alternative strapping for pad designs.

Referring to FIG. 11, pads can be optionally made to strap to the leg in a variety of ways, with three applications of a flexible banding system (111, 112 and 113). This banding could be made of neoprene, elastic or other similar material joined to the pre-curved pads.

Figure 12:
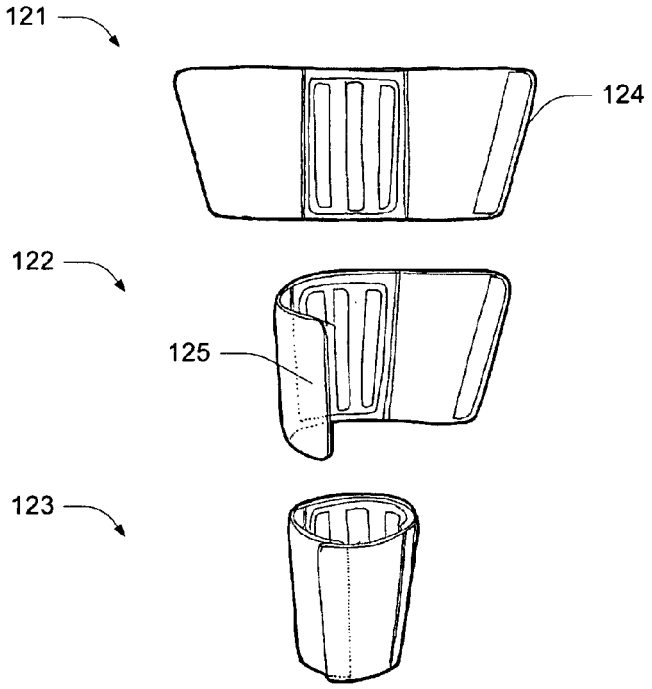
FIG. 12 Illustrates how a flat piece can wrap and close to form a sleeve, which can custom fit to a users thigh.

FIG. 12 shows that a relatively flat panel 121 can wrap 122 and close 123 to form a sleeve. This sleeve can be fastened for conforming to a custom fit of a users thigh. The material choice for this sleeve that wraps on with the pad pocket can similar to the construction of FIG. 4.

The pads can be preinstalled at manufacture by sewing them directly into the material. By way of example, an outer laminate 125 of the panel is a material that connects like Velcro loops to Velcro hooks 124 to provide a releasable fastening. The shape of the wrap and surface area of the Velcro hooks can be varied depending on the design choice. For example, some systems can wrap with one Velcro Hook tab, other systems could use two or three separate areas.

Figure 13:
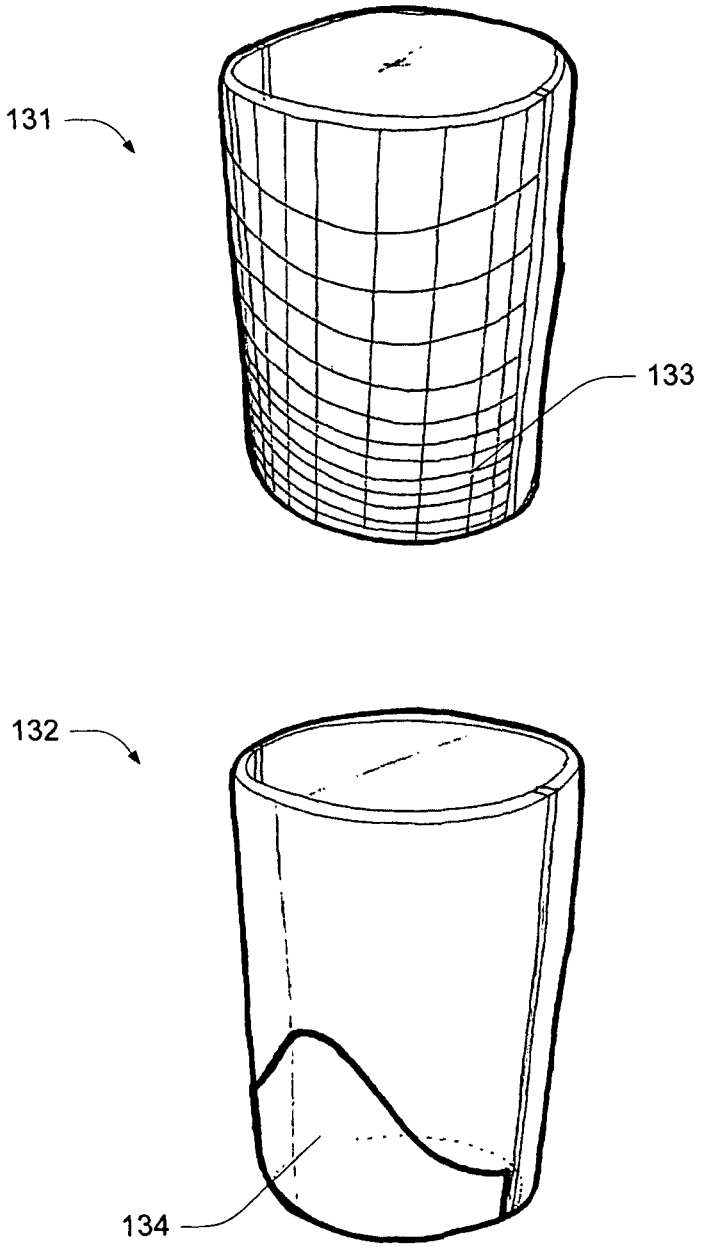
FIG. 13 Illustrates a sleeve with gradient lines to define a stretch gradient.

FIG. 13 shows a sleeve 131 with gradient lines 133 that describe a stretch gradient. In this example, the sleeve is tighter at the bottom of the sleeve.

It will be appreciated that there are various ways to construct a sleeve that approximates this stretch gradient. For example, use a tighter weave on the outer or inner laminated material to the sleeve. Another example includes, printing a pattern (e.g. 134) on the sleeve. Printing a pattern like 134, or similar, either on the inside (or outside, or both) laminated material will make the sleeve tighter at the bottom and emulate a stretch gradient similar to that shown in 131. This stretch gradient can help keep the pad stick firmly in place on the thigh, reducing the possibility of the sleeve moving down the leg during use.

The stretch gradient is used to reduce the possibility of the sleeve moving down the leg during use. By way of example, a stretch gradient can be achieved by printing a pattern onto an outer nylon surface of the panel or sleeve. Alternatively, the nylon layer can be manufactured to have the gradient integrated into the weave.

In other configurations for providing a suitable stretch gradient, a stretch pattern can be designed and printing onto the surface of a panel (or sleeve), such that in use the sleeve is tighter in various areas. This pattern can also be designed to more closely follow the ideal muscle compression for optimised hiking comfort, recovery and blood flow. The pattern can be printed on an interior or exterior surface of the panel (or sleeve).

The panel (or sleeve) can be wrapped and used with a Velcro closure or similar to provide a custom fit for the user. The sleeve can also be wrapped with Velcro tabs to provide closure and or support.

For easier manufacture and/or user convenience, the pads can be optionally preinstalled by sewing them into the panel (or sleeve). Further, a pair of sleeves can be attached to nylon briefs.

A sleeve can also work as a compression garment to reduce fatigue and enhance recovery of the working thigh muscles. The sleeve can be designed with optimum compression for hiking.

According with an embodiment, a hiking support system comprises a first substantially planar panel including a layer of lateral stretch Nylon, and Neoprene. Velcro strips are provided at opposite ends of the panel for releasably fastening these ends together to define a sleeve portion. The panel includes a pocket for retaining at least one resilient pad of predetermined stiffness. The pad is fixedly inserted in the pocket, and is comprised of Ethlene Vinyl Acetate (EVA) closed cell foam and high grade strength fibreglass battens. The sleeve, having the pad inserted, is adapted to be worn by a user for providing support to the user while hiking. The panel is adapted to be wrapped around the thigh of the user and fastened in a fitted operative sleeved configuration. Fastening is achieved using a Velcro closure. The panel has a stretch gradient for restricting movement of the sleeve portion during use.

By way of example only, the system can be used in a number of sailing environments, including:

- Hiking Pants for Small Boat Dinghy Sailing. In this example, a hiking system works well for sailors of dinghy classes, such as the Olympic Classes Laser or Finn as well as a large range of other classes of boat.
- Hiking Pants for Sportsboat Yachting. In this example, versions of a hiking system can be designed for sportsboat yachting. These systems typically have hiking pads and suit in different dimensions and materials.
- Hiking Shorts for Yachting. In this example a short version of the hiking system, with no straps and a thinner padded insert design may be used for yachting purposes, where the hiking is less strenuous.

As used herein, unless otherwise specified the use of the ordinal adjectives 'first', 'second', 'third', etc., to describe a common object, merely indicate that different instances of like objects are being referred to, and are not intended to imply that the objects so described must be in a given sequence, either temporally, spatially, in ranking, or in any other manner.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Although the invention has been described with reference to specific examples, it will be appreciated by those skilled in the art that the invention may be embodied in many other forms.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

What is claimed is:

1. A hiking support system comprising:

a first thigh sleeve portion having a pocket for receiving at least one resilient pad of predetermined stiffness;

wherein said first thigh sleeve portion, having said pad inserted, is adapted to be worn by a user for providing leg support to the user while hiking;

wherein said pocket is positioned on said first thigh sleeve portion such that it is behind the thigh of the user when said first thigh sleeve portion is worn;

and at least one resilient pad, having a first high transverse flexibility across the leg and a second lower longitudinal flexibility along the leg of the user;

wherein said sleeve portion comprises a substantially planar panel and a releasable fastener, wherein opposite ends of said panel are attachable by the releasable fastener to define said sleeve.

2. A system as claimed in claim 1, wherein said sleeve portion, having said pad inserted, is adapted to be worn by a user beneath a wetsuit for providing support to the user while hiking.

3. A system as claimed in claim 1, wherein said sleeve portion includes a stretch gradient along the leg for restricting movement of said sleeve portion during use.

4. A system as claimed in claim 3, wherein said stretch gradient is created by a printed pattern on a surface of the sleeve portion.

5. A system as claimed in claim 3, wherein said sleeve portion includes a nylon layer, wherein said nylon layer is manufactured to incorporate said stretch gradient in its weave.

6. A system as claimed in claim 3, wherein said sleeve portion is further adapted to stretch substantially more in a first direction than in a direction orthogonal to the first direction.

7. A system as claimed in claim 3 where the top and/or the bottom of said sleeve portion further includes an internal band of gripping material for gripping the leg of said user and reducing the possibility of the system moving down the leg during use.

8. A system as claimed in claim 1, wherein said pad is fixedly inserted in said pocket of said sleeve portion.

9. A system as claimed in claim 1, wherein said sleeve portion is further adapted as a compression garment for reducing fatigue and enhancing recovery of the users thigh muscles.

10. A system as claimed in claim 1, further comprising:

a second sleeve portion having a pocket for receiving a second pad, and having said second pad inserted;

wherein said first and second sleeve portion are attached to briefs such that said briefs can be worn by the user beneath said wetsuit.

11. A system as claimed in claim 1 wherein said pad is constructed from any one or more of the set comprising Ethylene Vinyl Acetate (EVA) sheeting, nylon laminated foam and neoprene, which is glued together over fibreglass battens.

12. A system as claimed in claim 1 wherein two or more pads are inserted in said pocket, wherein said pads are clipped together in their centre with a hook and loop type closure to maintain flexibility while used in combination.

13. A system as claimed in claim 1, wherein said pocket has at least one drain hole to substantially avoid retaining water in said pocket when in use.

14. A system as claimed in claim 1 further comprising:

a plurality of pads of various stiffness adapted to be inserted into said pockets.

15. A hiking support system comprising:

a first substantially planar panel with a releasable fastener on opposite ends of said panel for releasably fastening the ends together to define a first thigh sleeve portion; said panel including a pocket for receiving at least one resilient pad of predetermined stiffness;

wherein said first thigh sleeve portion, having said pad inserted, is adapted to be worn by a user for providing leg support to the user while hiking;

wherein said pocket is positioned on said first thigh sleeve portion such that it is behind the thigh of the user when said first thigh sleeve portion is worn;

and at least one resilient pad, having a first high transverse flexibility across the leg and a second lower longitudinal flexibility along the leg of the user.

16. A system as claimed in claim 15, wherein said panel is adapted for wrapping around the thigh of said user and fastening in a fitted operative sleeved configuration.

17. A system as claimed in claim 16, wherein said panel includes a stretch gradient along the leg for restricting movement of said sleeve portion during use.

18. A system as claimed in claim 17, wherein said pad is fixedly inserted in said pocket.

19. A system as claimed in claim 1, wherein said fastening is achieved using a hook and loop type closure.

20. A system as claimed in claim 1, wherein said pad comprises at least one sheet of flexible material and at least one batten.

* * * * *